US005894783A

United States Patent [19]

Hauser et al.

[11] Patent Number: 5,894,783

[45] Date of Patent: Apr. 20, 1999

[54] HYDROSTATIC TRANSMISSION SWASH PLATE ASSEMBLY

[75] Inventors: Raymond M. Hauser, Sullivan; John Schreier, Charleston, both of Ill.

[73] Assignee: Hydro-Gear Limited Partnership, Sullivan, Ill.

[21] Appl. No.: 08/886,597

[22] Filed: Jul. 1, 1997

[51] Int. Cl.[6] ..... F01B 3/00

[52] U.S. Cl. ..... 92/12.2; 92/57; 92/71; 417/269

[58] Field of Search ..... 60/487; 92/12.2, 92/57, 71; 417/269; 74/60

[56] References Cited

U.S. PATENT DOCUMENTS

| | | | |
|---|---|---|---|
| 4,037,521 | 7/1977 | McLeod | 92/71 X |
| 4,610,605 | 9/1986 | Hartley | 417/269 |
| 4,797,069 | 1/1989 | Hartley et al. | 92/12.2 X |
| 5,046,403 | 9/1991 | Riedhammer | 92/71 X |
| 5,497,623 | 3/1996 | Hauser et al. | 92/71 X |
| 5,632,607 | 5/1997 | Popescu et al. | 417/269 X |
| 5,644,970 | 7/1997 | Mishiyuki et al. | 417/269 X |

FOREIGN PATENT DOCUMENTS

| | | | |
|---|---|---|---|
| 175858 | 4/1955 | Sweden | 417/269 |

*Primary Examiner*—Hoang Nguyen
*Attorney, Agent, or Firm*—Thomas C. McDonough

[57] ABSTRACT

A swash plate assembly for use in connection with a hydrostatic transmission. The swash plate assembly comprises a thrust bearing and a swash plate formed as a net shaped part from a plastic material adapted to carry the thrust bearing wherein the swash plate has an elongated aperture for allowing a shaft to pass therethrough and a plurality of acoustical cavities formed in the underside thereof generally arranged around the elongated aperture and proximate to the thrust bearing.

17 Claims, 4 Drawing Sheets

HYDROSTATIC TRANSMISSION SWASH PLATE ASSEMBLY

BACKGROUND OF THE INVENTION

This invention relates generally to swash plates and, more particularly, relates to a swash plate assembly for use in a hydrostatic transmission.

Currently known hydrostatic transmissions comprise a hydraulic pump unit and a hydraulic motor unit. The hydraulic pump unit is hydraulically connected to the hydraulic motor unit through hydraulic porting, which may be formed in the housing, a center section, or the like, to form what is referred to as a hydraulic circuit. The hydraulic pump unit comprises a pump cylinder block having a plurality of piston receiving chambers formed therein in each of which is disposed a movable pump piston. Similarly, the hydraulic motor unit comprises a motor cylinder block having a plurality of piston receiving chambers formed therein in each of which is disposed a movable motor piston. An example of a hydrostatic transmission utilizing a center section may be seen in U.S. Pat. No. 5,330,394 to Hauser et al. entitled "Rider Transaxle having Improved Casing Design" which is incorporated herein by reference in its entirety.

An input shaft, which is driven by the engine of a vehicle, is drivingly connected to the hydraulic pump unit such that the rotation of the input shaft rotates the pump cylinder block therewith. The rotation of the pump cylinder block causes the pump pistons to travel up and down as they travel against a movable, metallic swash plate. As will be understood by those skilled in the art, the swash plate may be moved to a variety of positions to vary the stroke of the pump pistons. In particular, as the stroke of the pump pistons is varied, the volume of the hydraulic fluid pumped into the hydraulic porting will vary. Since the speed of the hydraulic motor unit is dependent upon the amount of hydraulic fluid pumped thereinto by the hydraulic pump unit, the positioning of the swash plate is seen to control the speed of the hydraulic motor unit. More specifically, each of the motor pistons is driven by the pumped hydraulic fluid against a fixed, angularly orientated motor thrust bearing such that the action of the motor pistons thereagainst forces the motor cylinder block to rotate.

While the currently utilized metallic swash plate works well for its intended purpose, it is seen to suffer from a number of drawbacks. In particular, prior art metallic swash plates have been seen to be relatively costly to manufacture owing to, among other things, the costs associated with forming the part from powdered metal or machining the part after it is formed from cast iron or aluminum. It is also seen that machining such parts may lead to stress induced fractures of the components during the operation of the transmission. In addition, owing to the relatively non-resilient characteristic of such metallic swash plates, the relative tolerances with which the part must be manufactured further function to increase the cost of their production. Furthermore, the use of metallic material in the construction of such swash plates functions to undesirably increase the overall weight of the hydrostatic transmission. As a result of these drawbacks, it is seen that a need exists in the art for an improved swash plate which need not be constructed from a metallic material.

As a result of this existing need, it is an object of the present invention to provide an improved swash plate for use in a transmission. It is a further object of the present invention to provide a swash plate for use in a transmission which is relatively less costly to manufacture. It is yet a further object of the present invention to provide a swash plate for use in a transmission which is formed as a net shape part thereby eliminating the need for machining. It is still a further object of the present invention to provide a swash plate for use in a transmission which is generally resilient thereby requiring relatively less exacting manufacturing tolerances. It is yet another object of the present invention to provide a swash plate for use in a transmission which functions to reduce the overall weight of the transmission. It is still another object of the present invention to provide a swash plate which functions to reduce the overall noise associated with the operation of the transmission.

SUMMARY OF THE INVENTION

In accordance with the present invention, a swash plate assembly for use in connection with a hydrostatic transmission is provided. In one embodiment, the assembly generally comprises a thrust bearing and a swash plate formed from a plastic material adapted to carry the thrust bearing. In a further embodiment, the assembly generally comprises a thrust bearing and a swash plate adapted to carry the thrust bearing having at least one acoustical cavity formed therein. In a more specific embodiment, the swash plate assembly comprises a thrust bearing and a swash plate formed as a net shaped part from a plastic material adapted to carry the thrust bearing wherein the swash plate has an elongated aperture for allowing a shaft to pass therethrough and a plurality of acoustical cavities formed in the underside thereof generally arranged around the elongated aperture and proximate to the thrust bearing.

A better understanding of the objects, advantages, features, properties and relationships of the invention will be obtained from the following detailed description and accompanying drawings which set forth an illustrative embodiment and are indicative of some of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION

While the invention can be used in connection with any type of device requiring a swash plate, it will be described hereinafter in the context of a hydrostatic transmission as the preferred embodiment thereof.

Figure 1:
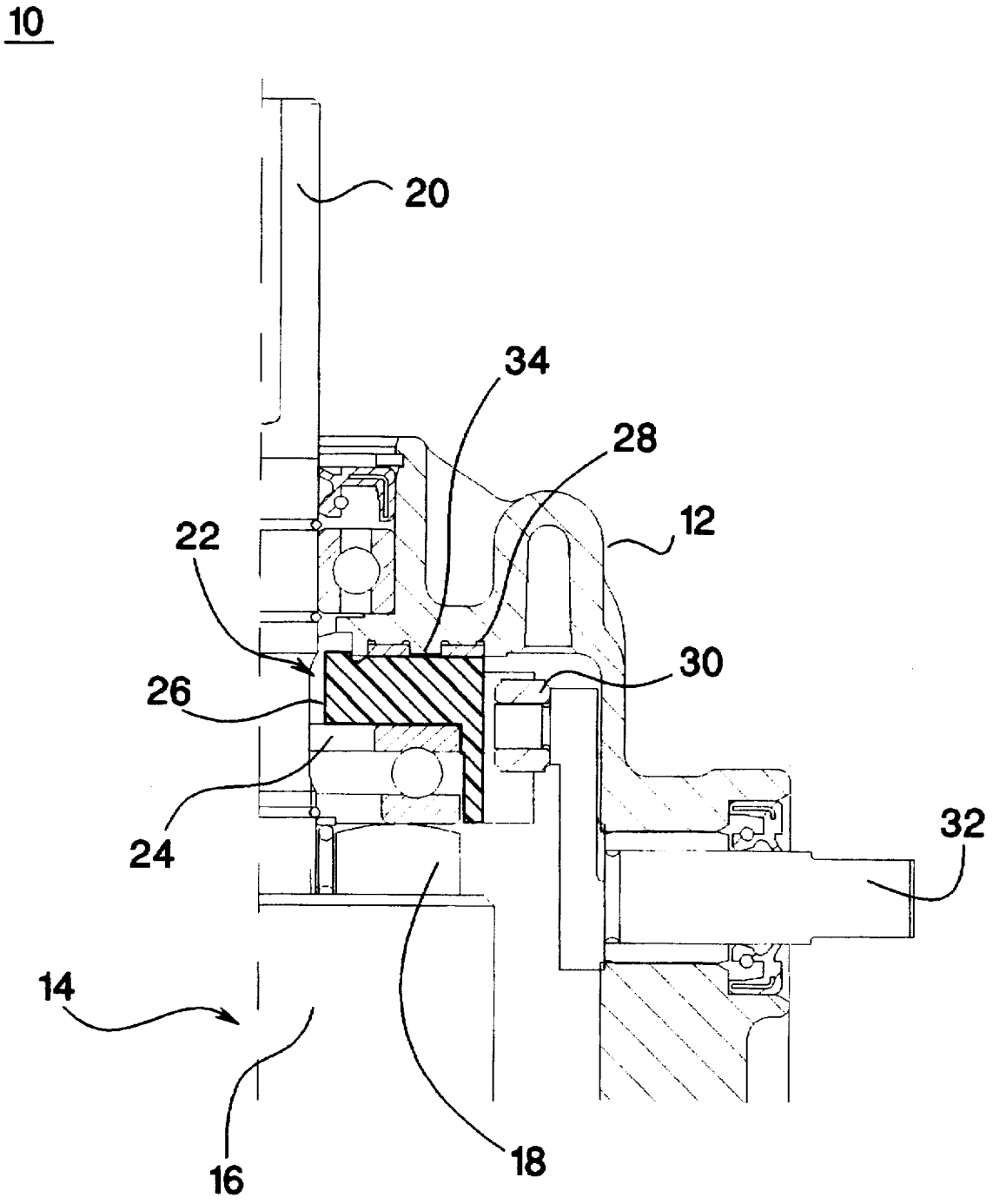
FIG. 1 illustrates a partial, cross sectional view of a hydrostatic transmission constructed in accordance with the present invention.

Referring now to the figures, wherein like reference numerals refer to like elements, there is shown in FIG. 1 a cross-sectional, partial view of a hydrostatic transmission 10. Specifically, the figure illustrates a housing 12 in which is disposed the hydraulic circuit of which the pump unit 14, comprised of a pump cylinder block 16 and pump pistons 18, is shown. The hydraulic transmission 10 also comprises an input shaft 20 drivingly connected to the pump unit 14, a moveable swash plate assembly 22 in engagement with the pump unit 14, generally arcuately shaped cradle bearings 28 constructed from a low-friction material disposed between the swash plate 26 and the housing 12, a slider block 30 slidably carried by the swash plate assembly 22, and a rotatable trunnion arm 32 rotatably engaged to the slider block 30 and carried by the housing 12. The swash plate assembly 22 is comprised of a hardened steel, three piece thrust bearing assembly 24 carried by a swash plate 26. The cradle bearings 28 include an aperture which is adapted to engage with protuberances 34 formed on the housing for preventing the movement of the cradle bearings 28 while the swash plate 26 travels thereagainst. To effectuate the operation of the hydrostatic transmission 10 as described in the BACKGROUND OF THE INVENTION section of this application, the trunnion arm 32 is rotated by means of a control arm (not illustrated) which causes the swash plate 26 to change its angular orientation with respect to the pump pistons 18.

Figure 2:
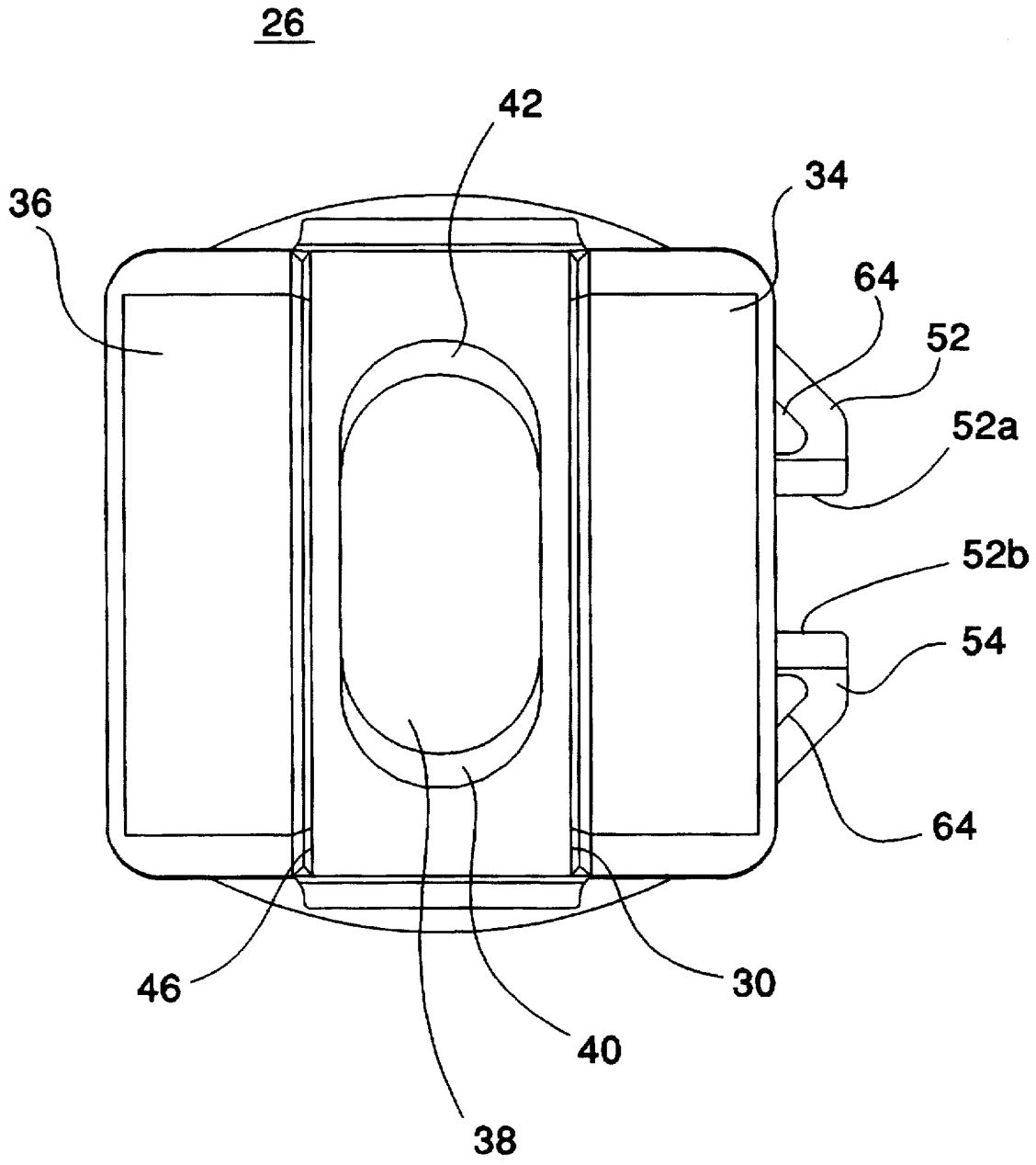
FIG. 2 illustrates a top view of a swash plate found in the hydrostatic transmission of FIG. 1.
Figure 3:
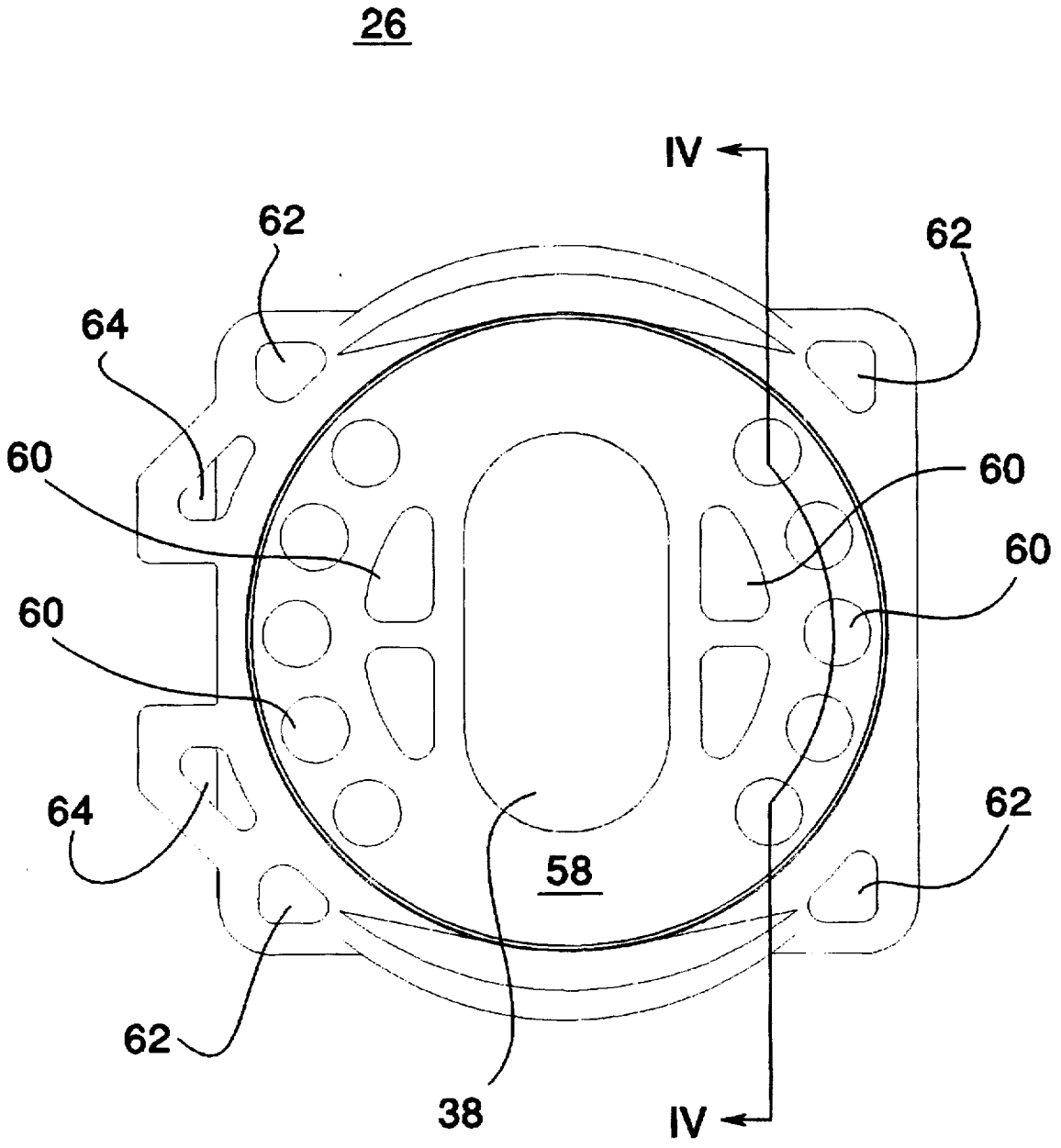
FIG. 3 illustrates a bottom view of the swash plate of FIG. 2.
Figure 4:
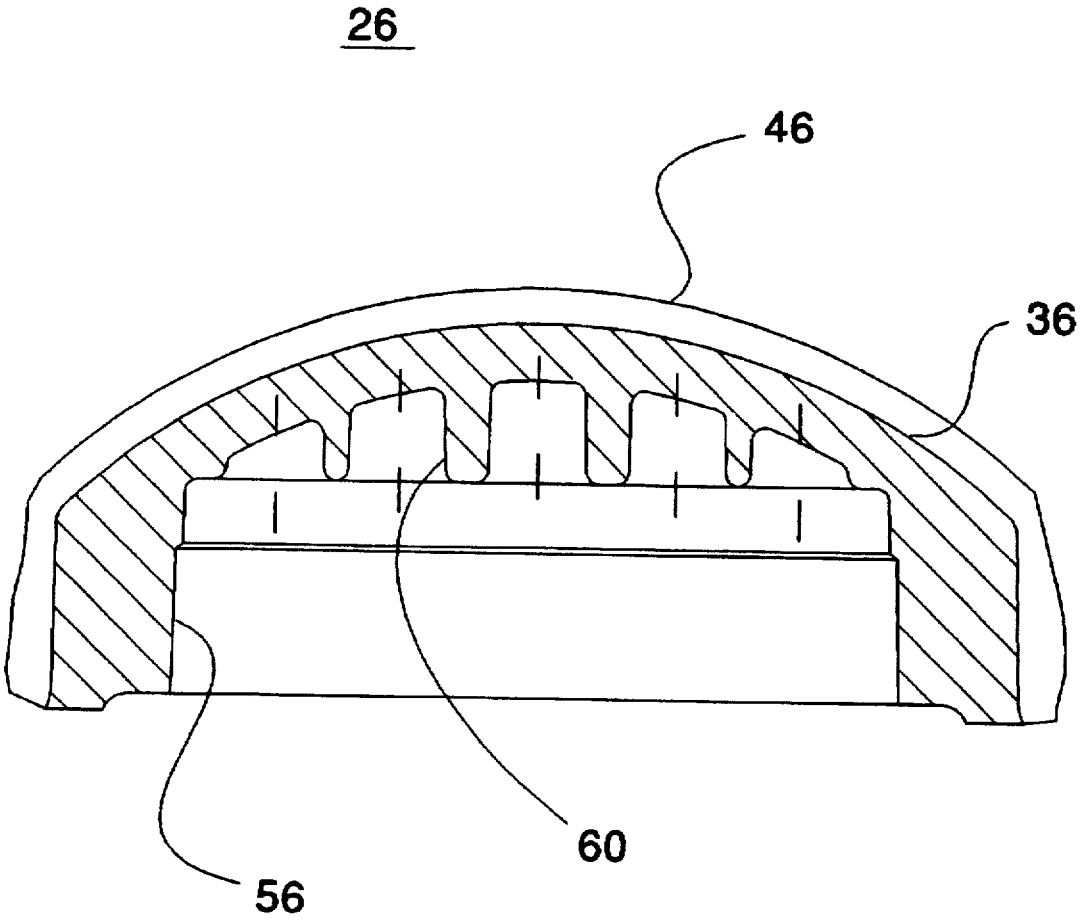
FIG. 4 illustrates a cross sectional view of the swash plate of FIG. 3 along line IV—IV thereof.

Turning to FIGS. 2–4, the swash plate 26 is shown in greater detail. The top of the swash plate 26 includes a pair of generally arcuate, cradle bearing running surfaces 34,36 disposed on either side of an elongated aperture 38 through which passes the input shaft 20. The aperture 38 includes angled end walls 40,42 so as to avoid interference with the input shaft 20 as the swash plate 26 is moved to its extreme positions. Positioned adjacent to each of the cradle bearing running surfaces 34,36 is a slight elevation 46,50 which cooperates with the cradle bearings to prevent lateral movement of the swash plate 26 within the housing 12. One of the sides of the swash plate 26 carries a pair of outwardly extending projections 52,54 which form a channel in which is slidably disposed the slider block 30. During operation, the slider block 30 engages the interior surfaces **52*a*,52*b* of the projections 52,54 for purposes of altering the angular orientation of the swash plate 26 as it is moved in either direction against the cradle bearings 28 at the command of the trunnion arm 32**.

The bottom of the swash plate 28 has a main cavity 56 formed therein which is sized and configured to accommodate the three piece thrust bearing assembly 24. In the illustrated embodiment, the main cavity 56 terminates in a generally flat end wall 58 for purposes of accommodating an appropriately configured thrust bearing assembly 24. Further formed in the flat end wall 58 are a plurality of optional end wall acoustical cavities 60 which serve to further enhance the noise reduction capabilities of the preferred construction materials. Additionally, these cavities 60 also serve to reduce the amount of material required in the construction of the swash plate 28 which advantageously reduces the cost of manufacturing the part and the overall weight thereof.

Yet a further reduction in the amount of material required to construct the swash plate 28 may be gained by providing the swash plate 28 with optional cavities 62 and apertures 64 without diminishing the structural integrity thereof.

In the preferred embodiment of the invention, the swash plate 26 is constructed from a plastic material such as RTP-4007 or the like as a net shape part. The use of this type of relatively less expensive material is advantageous in that it also functions to reduce the cost of manufacturing the component and, accordingly, the overall costs associated with constructing the hydrostatic transmission 10. Yet a further reduction in the cost of manufacturing the component results from the less exacting tolerances required in the manufacture of the swash plate 26 as a net shaped, plastic component. In particular, it has been seen that the prior art requires a rather exact machining of the cradle bearing running surfaces of the swash plate to provide the swash plate with bearing running surfaces which closely match the general arcuate shape of the cradle bearings for the purpose of minimizing any binding between the parts during the movement of the swash plate and the wear which will result therefrom. Additionally, the prior art requires a rather exact machining of the inner bearing surface of the swash plate to ensure that the thrust bearing is uniformly supported therein for the purpose of preventing cracking which may result from the stresses induced by the forces associated with the operation of the pump pistons as they bear against the thrust bearing. Meanwhile, in contradistinction to the prior art, the resilient characteristic of the plastic material utilized in the construction of the subject invention allows the surface of the swash plate 26 to conform its shape to that of the cradle bearings 28 such that the potential for binding and wear is reduced without the need for machining the part. The resilient characteristic of the plastic material also allows the inner bearing surface of the swash plate 26 to conform to the shape of the thrust bearing 24 to provide the desired, uniform support again without the need for further machining. The elimination of the need to machine the swash plate 26 is further seen to diminish the susceptibility of the swash plate to stress induced fractures in the surfaces or "skin" thereof which often times arise in similar prior art, machined swash plates. A further advantage associated with the use of the aforementioned material is the overall reduction in the weight of the hydrostatic transmission 10 and the general noise deadening characteristics of the material.

While specific embodiments of the invention have been described in detail, it will be appreciated by those skilled in the art that various modifications and alternatives to those details could be developed in light of the overall teachings of the disclosure. For example, while the swash plate has been illustrated as being used in connection with the pump unit of the hydraulic circuit, the teachings found herein may be used for purposes of modifying a swash plate associated with the motor unit to achieve the same advantages. Accordingly, the particular arrangements disclosed are meant to be illustrative only and not limiting as to the scope of the invention which is to be given the full breadth of the appended claims and any equivalent thereof.

What is claimed is:

1. A swash plate assembly for use in connection with a hydrostatic piston pump or motor unit, comprising:

a thrust bearing; and a swash plate formed from a plastic material adapted to carry said thrust bearing, said swash plate having at least one acoustical cavity formed therein.

2. The swash plate assembly as recited in claim 1, wherein said swash plate has a plurality of acoustical cavities formed in the underside thereof generally adjacent to said thrust bearing.

3. The swash plate assembly as recited in claim 1, wherein said swash plate has at least one aperture disposed proximate to the outer perimeter thereof for purposes of reducing the amount of material used in its construction.

4. A swash plate assembly for use in connection with a hydrostatic pump or motor unit, comprising:

a thrust bearing; and a swash plate adapted to carry said thrust bearing having at least one acoustical cavity formed therein.

5. The swash plate assembly as recited in claim 4, wherein said swash plate has a plurality of acoustical cavities formed in the underside thereof generally adjacent to said thrust bearing.

6. A swash plate assembly for use in connection with a hydrostatic pump or motor unit, comprising:

a thrust bearing; and a swash plate formed as a net shaped part from a plastic material adapted to carry said thrust bearing, said swash plate having an elongated aperture for allowing a shaft to pass therethrough and a plurality of acoustical cavities formed in the underside thereof generally arranged around said elongated aperture and proximate to said thrust bearing.

7. A hydrostatic transmission, comprising:

a housing;

a hydraulic circuit disposed within said housing comprising a hydraulic motor unit and a hydraulic pump unit; and a swash plate assembly disposed within said housing and engageable with said hydraulic pump for use in controlling the flow of a hydraulic fluid through said hydraulic circuit, said swash plate assembly comprising a thrust bearing and a swash plate formed from a plastic material adapted to carry said thrust bearing, and said swash plate having at least one acoustical cavity formed therein.

8. The hydrostatic transmission as recited in claim 7, wherein said swash plate assembly is adapted to control the operation of said hydraulic pump unit of said hydraulic circuit.

9. The hydrostatic transmission as recited in claim 7, wherein said swash plate assembly is adapted to control the operation of said hydraulic motor unit of said hydraulic circuit.

10. The hydrostatic transmission as recited in claim 7, wherein said swash plate has a plurality of acoustical cavities formed in the underside thereof generally adjacent to said thrust bearing.

11. The hydrostatic transmission as recited in claim 7, wherein said swash plate has at least one aperture disposed proximate to the outer perimeter thereof for purposes of reducing the amount of material used in its construction.

12. A hydrostatic transmission, comprising:

a housing;

a hydraulic circuit disposed within said housing comprising a hydraulic motor unit and a hydraulic pump unit; and a swash plate assembly disposed within said housing and engageable with said hydraulic circuit for use in controlling the flow of a hydraulic fluid therethrough, said swash plate assembly comprising a thrust bearing and a swash plate adapted to carry said thrust bearing having at least one acoustical cavity formed therein proximate to said thrust bearing.

13. The hydrostatic transmission as recited in claim 12, wherein said swash plate assembly is adapted to control the operation of said hydraulic pump unit of said hydraulic circuit.

14. The hydrostatic transmission as recited in claim 12, wherein said swash plate assembly is adapted to control the operation of said hydraulic motor unit of said hydraulic circuit.

15. A swash plate assembly for use in connection with a hydrostatic pump having a plurality of pistons, comprising:

a swash plate formed from a plastic material and having at least one acoustical cavity formed therein; and a thrust bearing comprising a first piece engaging and held by said swash plate, a second piece engaging said pistons and rotatable with respect to said first piece and a rotatable bearing race between said first and second pieces.

16. The swash plate assembly as recited in claim 15, wherein said swash plate has a plurality of acoustical cavities formed in the underside thereof generally adjacent to said thrust bearing.

17. The swash plate assembly as recited in claim 15, wherein said swash plate has at least one aperture disposed proximate to the outer perimeter thereof for purposes of reducing the amount of material used in its construction.

* * * * *